US006843159B2

(12) United States Patent
Pek et al.

(10) Patent No.: US 6,843,159 B2
(45) Date of Patent: Jan. 18, 2005

(54) MOBILE ARTILLERY SYSTEM

(75) Inventors: Chong Guat Pek, Singapore (SG); Richard Foo, Singapore (SG); Andy See, Singapore (SG); Swam Wui Lim, Singapore (SG); Khee Teik Phey, Singapore (SG)

(73) Assignee: Ordnance Development and Engineering Company of Singapore, Singapore (SG)

( * ) Notice: Subject to any disclaimer, the term of this patent is extended or adjusted under 35 U.S.C. 154(b) by 0 days.

(21) Appl. No.: 10/097,147

(22) Filed: Mar. 13, 2002

(65) Prior Publication Data

US 2002/0129696 A1 Sep. 19, 2002

(30) Foreign Application Priority Data

Mar. 14, 2001 (SG) ..... 200101578-3

(51) Int. Cl.[7] ..... F41A 23/30

(52) U.S. Cl. ..... 89/40.11; 89/37.13; 89/40.04; 89/40.09; 89/40.15

(58) Field of Search ..... 89/37.13, 37.07, 89/37.01, 37.14, 40.04, 40.09, 40.11, 40.15

(56) References Cited

U.S. PATENT DOCUMENTS

| | | | | |
|---|---|---|---|---|
| 1,310,144 A | * | 7/1919 | Schneider | |
| 1,310,146 A | * | 7/1919 | Schneider | |
| 1,829,669 A | * | 10/1931 | Pavesi | |
| 2,103,670 A | * | 12/1937 | Hammar et al. | |
| 2,199,392 A | * | 5/1940 | Dabrasky | |
| 2,415,024 A | * | 1/1947 | Allen | |
| 4,624,425 A | | 11/1986 | Austin et al. | 244/13 |

FOREIGN PATENT DOCUMENTS

| | | | | |
|---|---|---|---|---|
| DE | 1 962 766 | * | 3/1971 | 89/40.11 |
| EP | 0153462 | | 9/1985 | |
| EP | 1111324 | | 6/2001 | |
| FR | 815.874 | * | 7/1937 | 89/40.11 |
| GB | 2 198 823 A | * | 6/1988 | 89/40.11 |
| WO | 8500217 | | 1/1985 | |

* cited by examiner

*Primary Examiner*—Stephen M. Johnson
(74) *Attorney, Agent, or Firm*—Ladas & Parry LLP

(57) ABSTRACT

The invention provides a self-propelled mobile system that is characterized by a lightweight space frame chassis on which is mounted a large caliber artillery piece. The weight of the system is preferably less than 8,000 kg and the artillery piece preferably has a caliber of up to a 155 mm 52 caliber gun. The artillery piece may include a lightweight elevating and traversing mass and gun chassis mounted on a space frame vehicle, such vehicle having a weight which does not exceed 3,800 kg.

27 Claims, 12 Drawing Sheets

MOBILE ARTILLERY SYSTEM

FIELD OF THE INVENTION

The present invention relates to a self-propelled mobile system. Although for convenience, the description describes such a system that includes an artillery gun, such as a howitzer, mounted onto a vehicular platform for rapid deployment in the battlefield, it should be appreciated that the invention need not include such an artillery gun. In particular the system is lightweight and maneuverable.

BACKGROUND OF THE INVENTION

The emerging trend in today's battlefield is to employ a rapid deployment force, which is lighter more lethal and less dependent on logistic tails. A highly agile and capable force must be sufficiently versatile to sustain a high operating tempo and defeat the opponent with minimum losses. They must then quickly re-position, re-focus end execute subsequent missions against an opponent by employing asymmetric means.

Currently, artillery support brigades operate large artillery weapons, such as howitzers which are towed. These howitzers are not integrated with the vehicles by which they are towed but may have auxiliary power units that are capable of propelling them to a maximum speed of about 20 km/h on paved roads and half that speed off-road. An example of such a system is the 155 mm/52 caliber FH2000 self propelled howitzer, which consists of a howitzer mounted with an auxiliary power unit (APU). These howitzer systems are relatively heavy and may need to be supported by a tow vehicle and ammunition supply train during long-distance operations. The main problem with such equipment is its limited maneuverability, which largely depends on the tow vehicle and the ability of the logistics support train to reequip. Loading onto fixed-wing aircraft is also difficult due to its weight and bulk and/or the need for it to be towed into the aircraft. Other howitzer systems may be tracked, but these are unable to attain high speeds of say up to 80 km/h and are not capable of being airlifted.

In today's battlefield, the lack of mobility can well mean a lower survival probability, as shoot and scoot capability is important. It is with this motivation that the present invention of a lightweight self-propelled howitzer was conceptualized.

SUMMARY OF THE INVENTION

It is an object of the present invention to provide a field artillery system that has improved firepower, in terms lethally and accuracy.

It is another object of the invention to provide a field artillery system that is mobile, both strategically and tactically, whether in the air or on the ground.

It is also an object of this invention to provide a field artillery system that has improved survivability in the field of operations and which requires minimal logistics support.

According to one aspect of the present invention, there is provided a self-propelled mobile artillery system characterized by a lightweight space frame chassis on which is mounted a large caliber artillery place.

An artillery system in accordance with the invention has the advantage that it is lighter, faster and more maneuverable than existing long range artillery systems such as those disclosed above.

Preferably, the weight of the system is loss then 8,000 kg, and the artillery piece has a caliber of up to 155 mm 52 caliber. Furthermore, it is advantageous for the artillery piece to have a firing system which includes an evaluating and traversing mass and gun chassis mounted on the space frame vehicle having a weight which does not exceed 3.800 kg.

In the preferred embodiment, the system includes duel-purpose hydro-pneumatic cylinders which provide suspension damping of the rear wheels and also are operable to move me rear wheels away from the ground for firing of the artillery piece. This has the advantage that stability of the system is improved during firing. The stability may be further improved by provision of retractable outriggers built at the rear of the gun chassis, each of which has a spade on its free end, the outriggers being operable to engage the ground with the spades embedded therein upon firing of the artillery piece. This will result in the transfer of most of the recoil load to the ground.

Front wheels of the system are preferably mounted on the chassis by means of a multi-link independent suspension system. Advantageously, each such suspension system includes a hydro-pneumatic strut, which preferably utilizes nitrogen gas as a spring and hydraulic fluid as a damper, connected to a suspension arm which not only absorbs both shock and vibrations from the front wheels which arise during transit of the system and counter-recoil forces which arise during firing of the artillery piece, but also can have their length adjusted to vary the ride height of the system. This has be advantage that the ground clearance of the chassis can be adjusted to suit the particular terrain over which it is traveling and also to enable it to be loaded more easily onto transport vehicles such as fixed or rotary wing aircraft. A lower gun elevation can also be attained to enable the gun to fire at a lower elevation angle. This will contribute to the direct fire capability of the gun.

The drive of the system is preferably provided by a turbo-charged inter-cooled diesel engine which is coupled to a hydromechanical transmission. One drive line, preferably the rear wheel drive, may then be effected by use of radial piston in-hub moors in the rear wheels, which have the advantage that they provide good spatial configuration for mounting the weapon platform and allow the weapon recoil force to be fully transferred to the ground. As a result, there is a smaller overall lading on the vehicle structure so that further weight saving is possible.

Front wheel drive may also be provided by means or a hydromechanical gearbox which drives the front wheels. A microprocessor may also then be provided to enable drive modes to be switched between front wheel drive, roar wheel drive and four wheel drive modes to suit the particular terrain and circumstances.

Other improvements and advantages of the invention will become apparent from the specific embodiment described below.

It will be convenient to hereinafter describe an embodiment of the present invention with reference to the accompanying drawings which illustrate one form of a mobile artillery system incorporating the invention. It is to be understood that the particularity of the drawings and the related description is not to be under as superseding the generality of the broad description of the invention as defined in the claims.

DETAILED DESCRIPTION OF THE PREFERRED EMBODIMENT

Incorporation of a Space Frame Chassis

Figure 1:
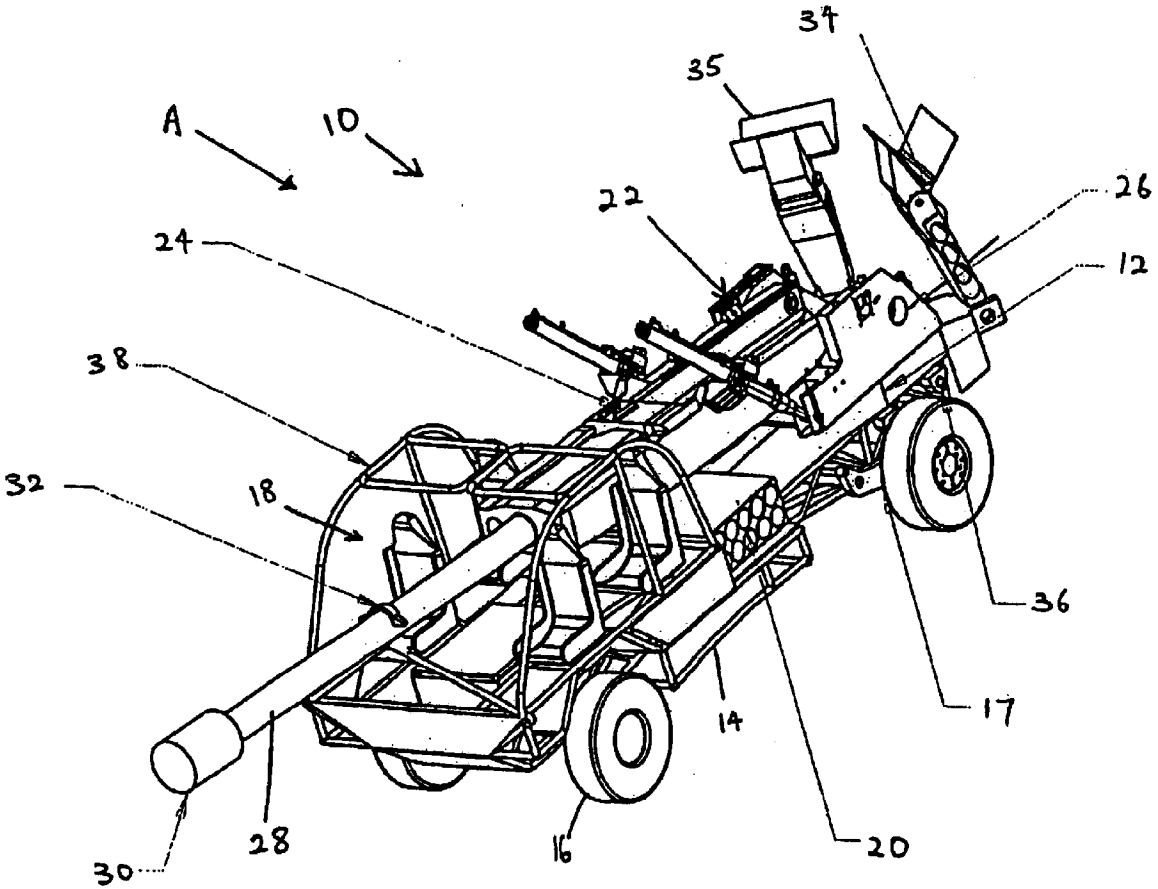
FIG. 1 is a perspective view of a mobile artillery system according to one embodiment of the invention.
Figure 1A:
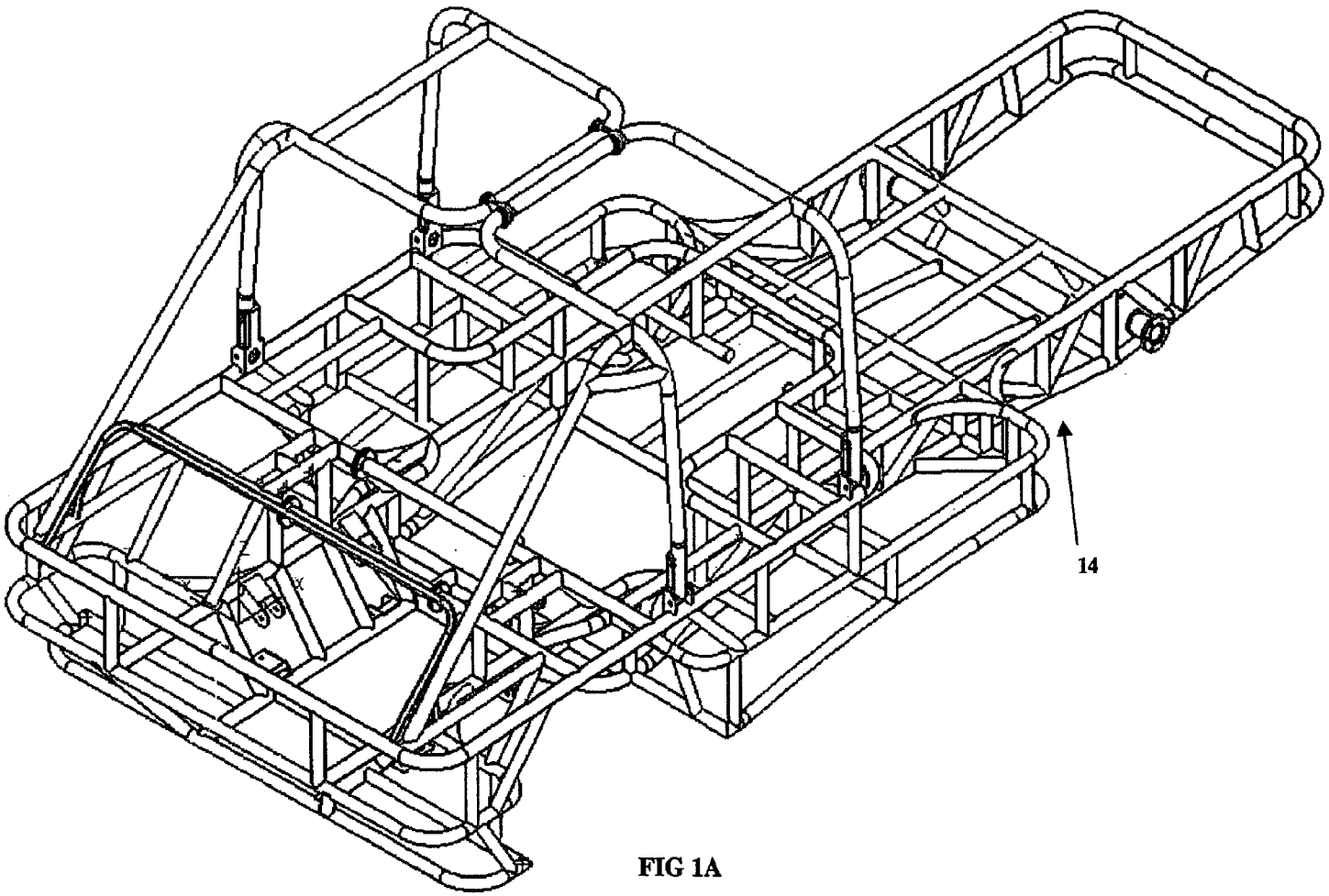
FIG. 1*a* is a perspective view of only the space frame of the mobile artillery system of FIG. 1 with all the other parts removed.

FIG. 1 is a perspective view of a mobile artillery system according to one embodiment of the invention. The system includes a light weight vehicle 10 with a chassis 12 that comprises primarily of a space frame structure 14. The space frame structure can be more clear seen from FIG. 1*a*, wherein all the other parts of the mobile artillery system have been removed. The space frame 14 requires less material to manufacture and makes the whole structure light-weight. The lightweight space frame design makes the complete system both air-portable and heli-portable. The design of the space frame 14 can thus be relatively light but achieve both structural and dynamic rigidity. The space frame 14 not only has to carry the intended payload, but can also withstand the stress and fatigue from pronged travelling on off-road terrain.

The space frame 14 of the vehicle 10 is reinforced at the points where the load is being transferred. The members of the apace frame 14 are positioned to achieve maximum torsional and structural rigidity. The vehicle may be powered by a 125 kW turbo-charged intercooled diesel engine. The engine and necessary transmission lines are held on the vehicle chassis 12 via the space frame 14. This is to reduce the weight of the comply system.

The chassis 12 has front wheels 16 and rear wheels 17 mounted to it, and a driver compartment 18 towards the front of the vehicle 10 for steering the vehicle. A compartment for ammunition storage 20 may be incorporated to the chassis 12.

Mounted on top of the vehicle chassis 12 and integrated with the vehicle chassis 12 is a weapons system including a howitzer gun 22, supported by a cradle 24 and saddle 26. The howitzer gun 22 includes a barrel 28 and muzzle brake 30. A barrel clamp 32 clamps the barrel 28 to the space frame 14 when the howitzer gun 22 is not in use.

At the rear of the vehicle, a pair of outriggers 34 are mounted for stabilising the system structure during firing. The outriggers 34 are movable and retractable using hydraulic pistons (not shown) such that they may be raised in the position shown or lowered to engage the ground when in the firing position.

Figure 3:
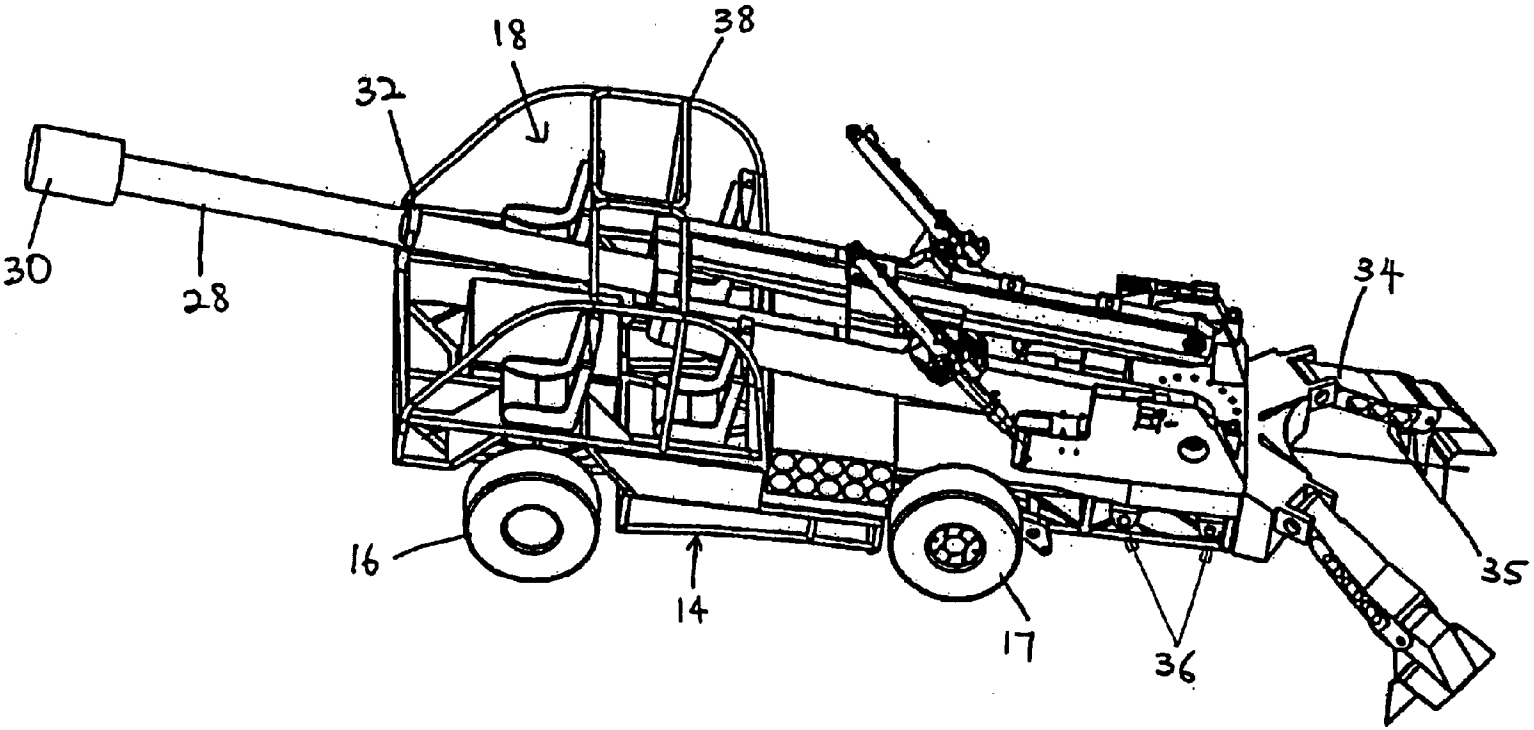
FIG. 3 is a side prospective view of the mobile artillery system of FIG. 1.
Figure 4:
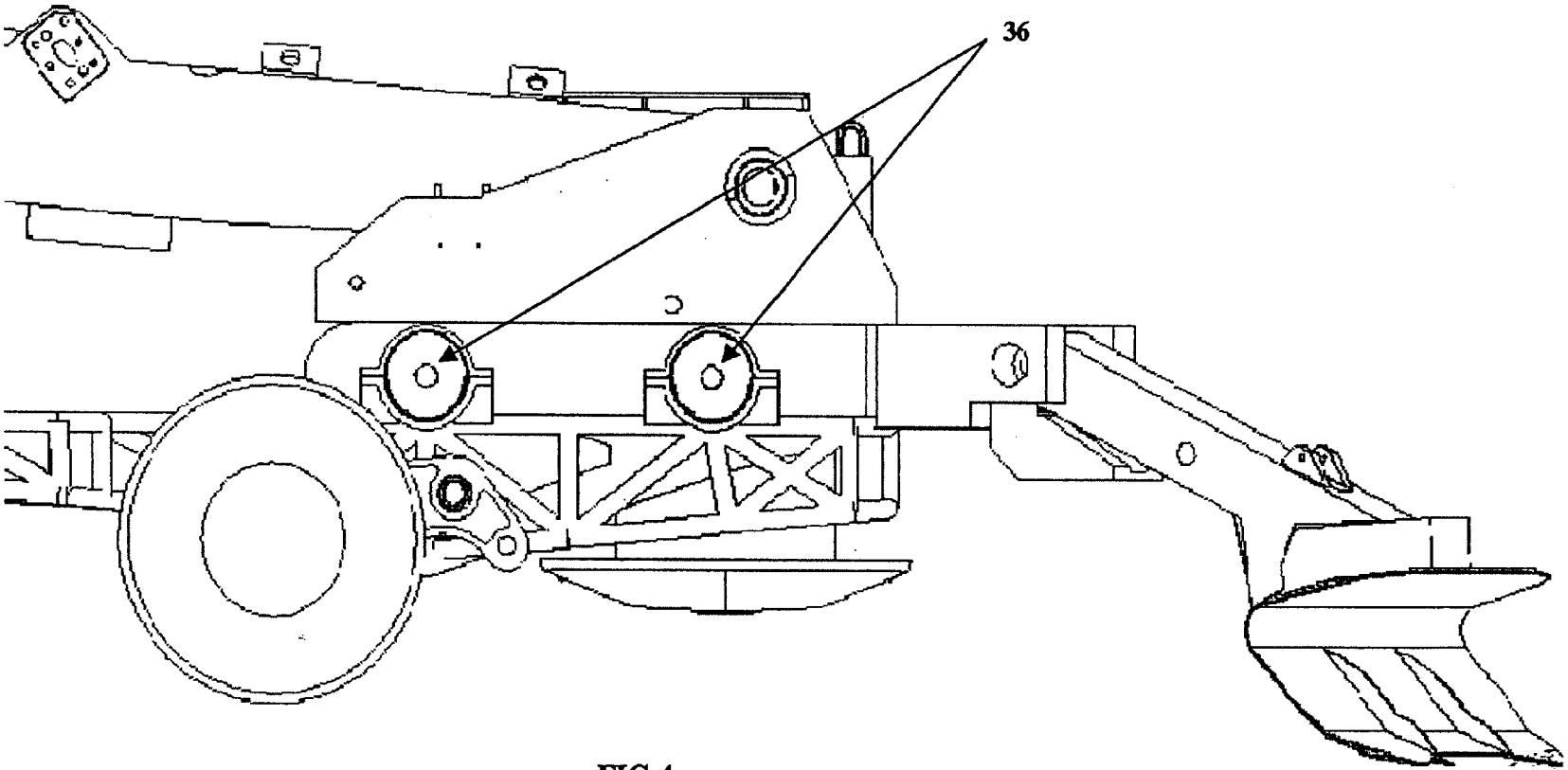
FIG. 4 is a side view of the mobile artillery system, including shock

In order to preserve the integrity of the lightweight space frame structure 14, the recoil force is isolated by means of shock isolators 36 positioned between the gun chassis and the vehicle structure. They can also dampen vibration when the vehicle is travelling from point to point. The shock isolators are sized and mounted onto the space frame structure 14 by four mounting brackets. These mounting brackets are preferably welded onto the space frame 14 as shown in FIGS. 3 and 4. Two shafts (not shown) run the length of the gun chassis through the holes of the shock isolators 36. The vehicle chassis 12 will then be supported by these shock isolators which help to reduce the amount of force that is being transmuted to the space frame structure 14. During firing, the recoil load is transmitted from the union to the gun chassis, shock isolator shafts and finally to the shock isolator 36. The shock isolators 36 serve to isolate the firing load that is being transmitted to the space frame 14, thereby protecting it from damage. FIGS. 3 and 4 show only one embodiment of the shock isolators 36 and the mounting brackets mounted to the space frame. It should be apparent that other embodiments are possible, wherein the firing load is transmitted to the space frame 14. As such the vehicle structure can be optimized to be as light as possible and yet able to handle the tremendous firing load.

In addition, rollover bars 38 are designed to surround the driver compartment 18 to protect the driver and passengers in the event the vehicle rolls over, for example in undulating terrain. Each outrigger 34 has a spade structure 35 at its end. The spade structure 35 is self-embedding once the outrigger 34 is lowered by the hydraulic pistons. The embedding of the spade structure 35 enhances the stability of the howitzer gun 22 once deployed to be fixed to the ground and enables the first shot to be fired at high accuracy.

Figure 2:
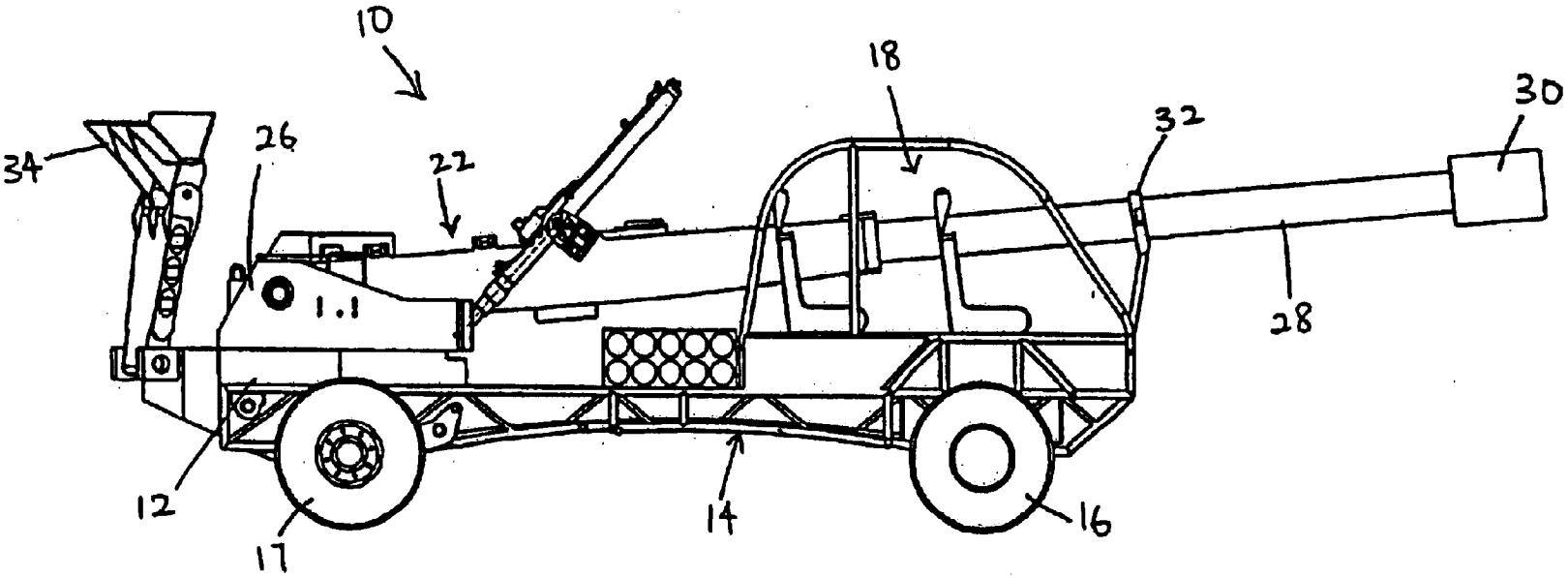
FIG. 2 is a side view of the mobile artillery system locking from position A of FIG. 1.

FIG. 2 is a side view of the mobile artillery system looking from position A of FIG. 1. FIG. 3 is a side perspective view of the mobile artillery system of FIG. 1.

The capability of the system to be both lightweight and attain structural rigidity enhances the effectiveness of the rapid deployment force to respond quickly to an emerging crisis in less time from base to a global theatre of operation. The integrated system offers high ground tactical mobility because of its capability to move rapidly about the battlefield. The howitzer 72 can thus be rapidly deployed to, critical areas immediately upon landing so as to exert influence on the battlefield. Likewise, the howitzer 22 has the capability to evacuate from critical areas immediately. In the battlefield, high mobility means higher survival probability. The system, including the howitzer gun 22 also functions as the tow vehicle and logistic train, thus eliminating the dependency on a separate tow vehicle and logistics train.

There are two operating modes of the artillery firing system, the traveling mode and the fling mode. In the travelling mode, the elevation of the gun barrel 28 is kept low and passes through the cab of the vehicle (see FIG. 1). The safety roll-over bar 38 is hinged at both sides of the vehicle. It can be opened up from the midline at the top to allow transgressing and elevation of the gun barrel 28 (sea FIG. 2). In the firing mode, the outriggers 34 are lowered so that the spade structure 35 engages the ground to stabilize the howitzer gun 22 during firing, and the rear wheels 17 are lifted off the ground using trailing arms powered by hydropneumatic cylinder (72 in FIGS. 6*a*–5*c*) which function also as a rear wheel suspension. This lowers the rear end of the chassis 12 together with the gun platform to touch the ground.

Rear Wheel Assembly

Figure 5A:
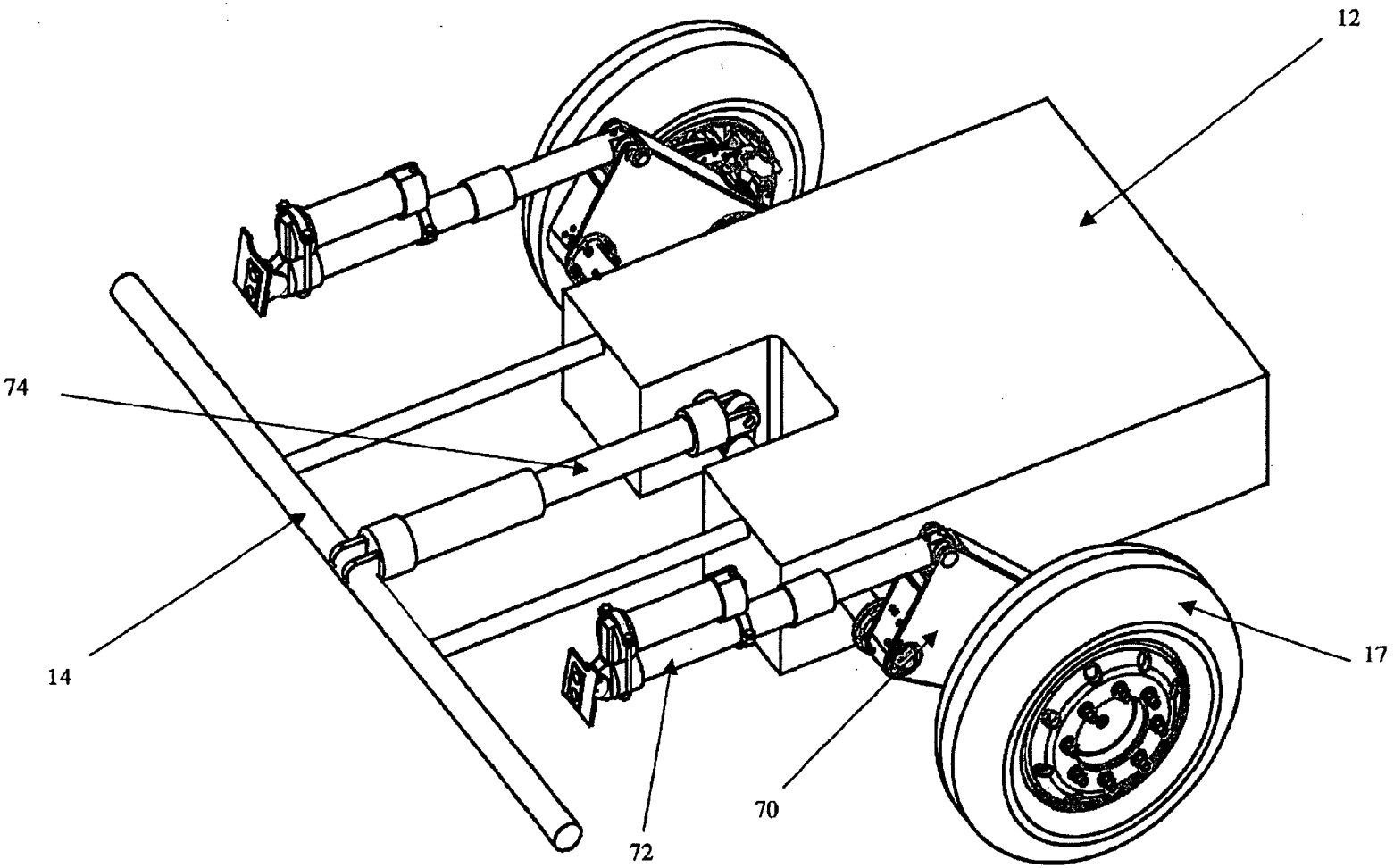
FIGS. 5*a* to 5*c* illustrate the travelling positions of the rear wheels of the mobile artillery system from an extended to a fully retracted position.
Figure 5B:
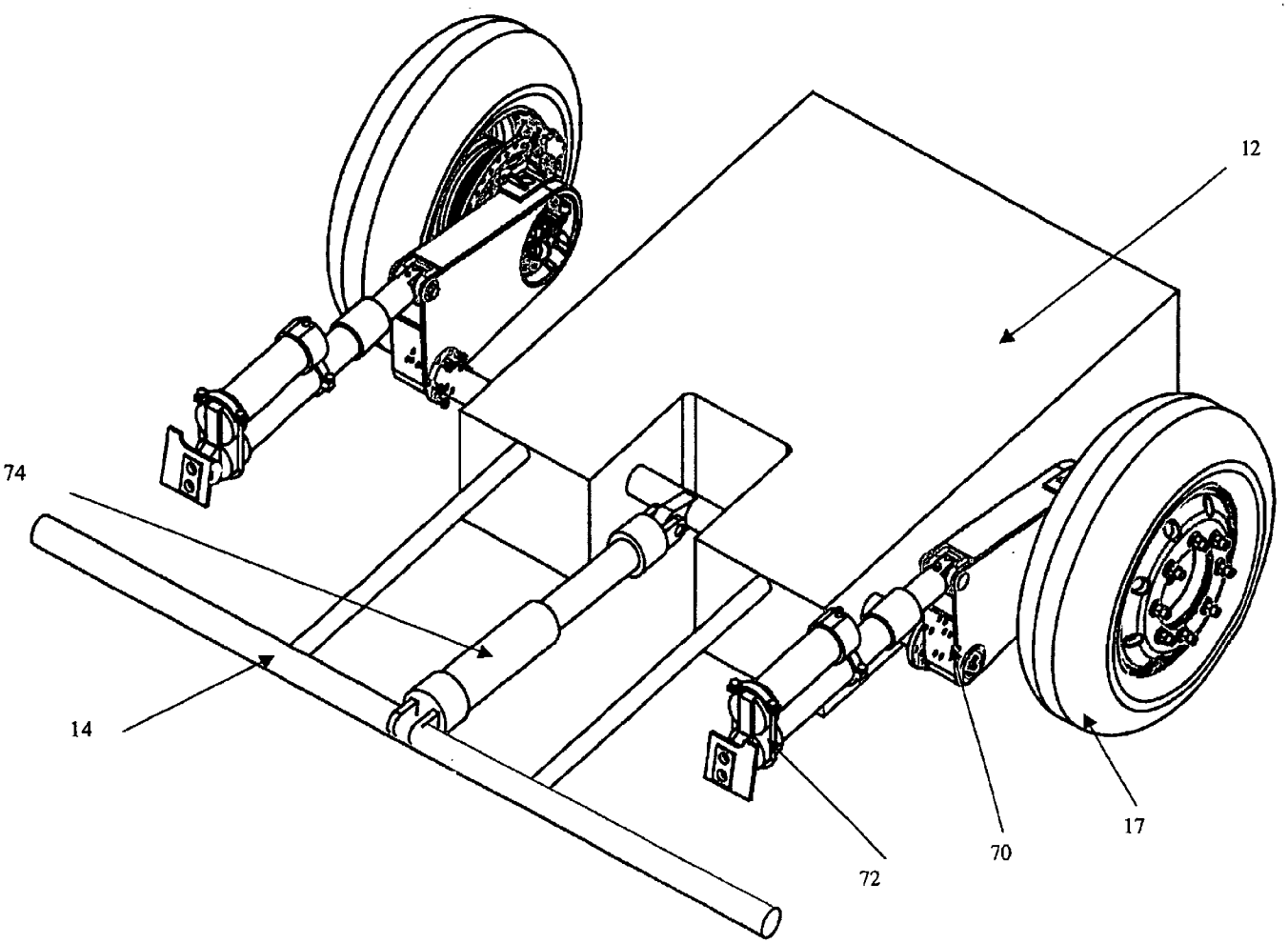
Figure 5C:
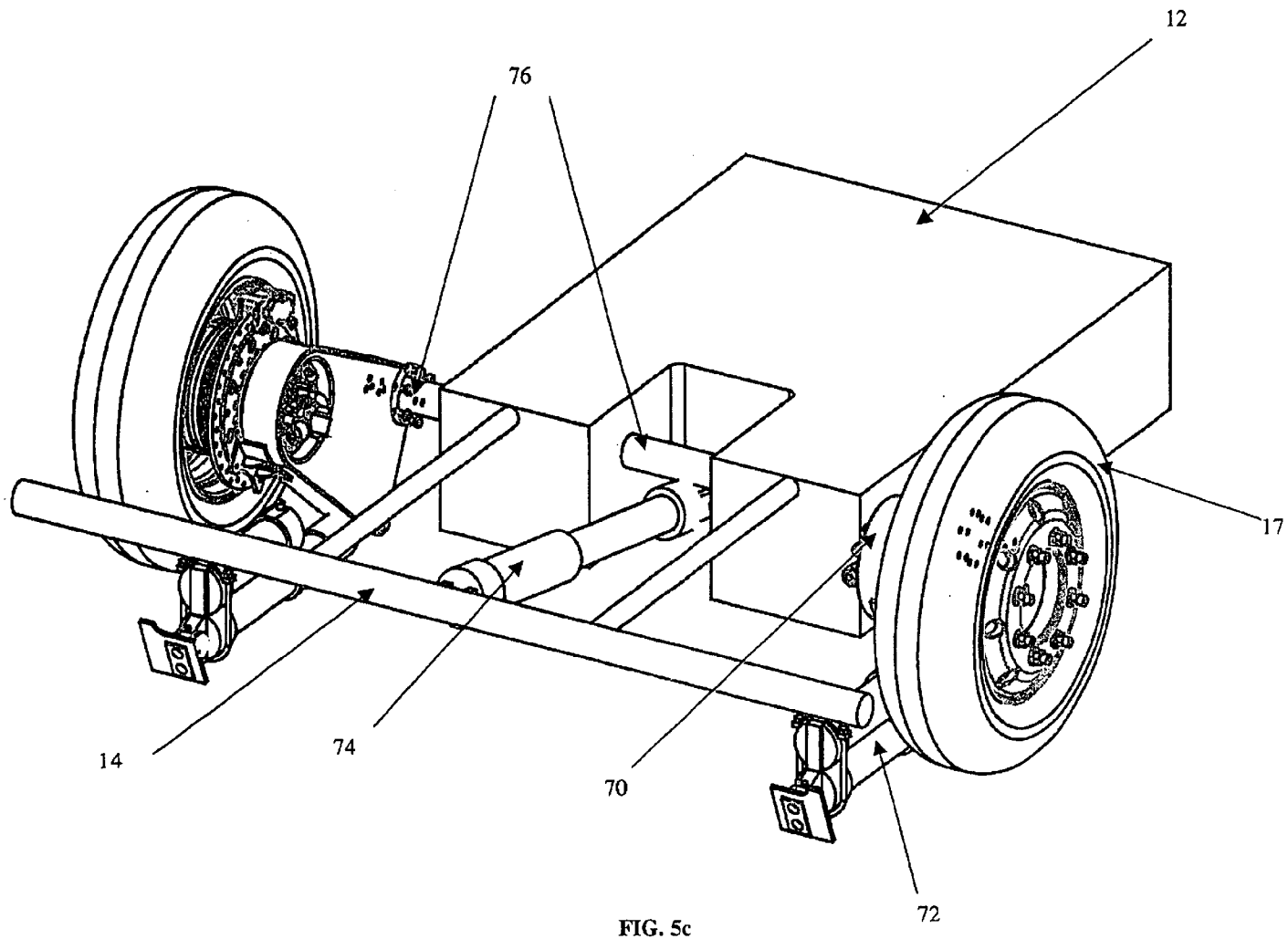

FIGS. 5*a* to 5*c* illustrate the travelling positions of the rear wheels from a extended position wherein the wheels are in contact with the ground, to a fully extended retracted position, wherein the wheels are lifted off the ground. The rear wheels 17 are mounted onto specially designed wheel arms 70. The wheel arms 70 are pivotally attached to the chassis 12. Alternatively, it could be pivotally attached to the structure of the space frame 14. Adjacent to the point of attachment of the wheel arm 70 to the chassis 12, side hydro-pneumatic struts 72 are pivotally connected to the wheel arms 70. As can be observed, extension and contraction of the side hydro-pneumatic struts 72 result in the raising and lowering of the rear wheels 17 in a leveraged arrangement. Between the side hydro-pneumatic struts 72, a centre hydro-pneumatic strut 74 is positioned to provide an additional force to ensure that the rear wheels 17 are fully raised when the side hydro pneumatic struts 72 are extended. The side hydro-pneumatic struts 72 and centre hydro-pneumatic struts 74 are interconnected by a portion of the space frame 14.

FIG. 5*a* shows the side hydro-pneumatic struts 72 in a extended position and the rear wheels 17 lowered to be in contact with the ground. FIG. 5*b* shows the side hydro-pneumatic struts 72 in an extended retracted position such that the rear wheels 17 are rotated counter-clockwise and are raised off the ground. In this position, the rear wheels 17 are still not fully retracted. FIG. 5*c* shows the rear wheels 17 in a fully retracted position.

The centre hydro-pneumatic strut 74 has been extended to push the axle 76 further so that the wheel arm 70 is almost horizontal and the rear wheels 17 are brought further towards the front of the vehicle.

Multi-Link Suspension System

Figure 6:
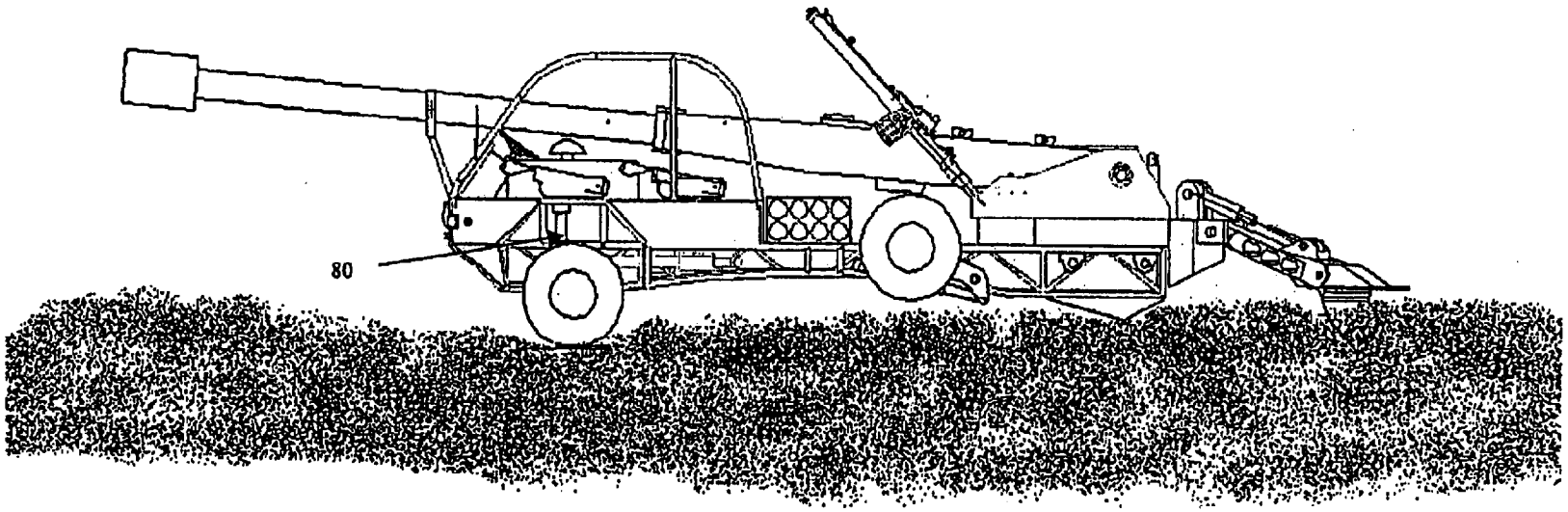
FIG. 6 is a side view of the mobile artillery system illustrating the suspension system.

FIG. 6 is a side view of the mobile artillery system giving an overview of the suspension system associated with the front wheels 16. A multi-link suspension 80 is incorporated to the front wheels 16.

Figure 7:
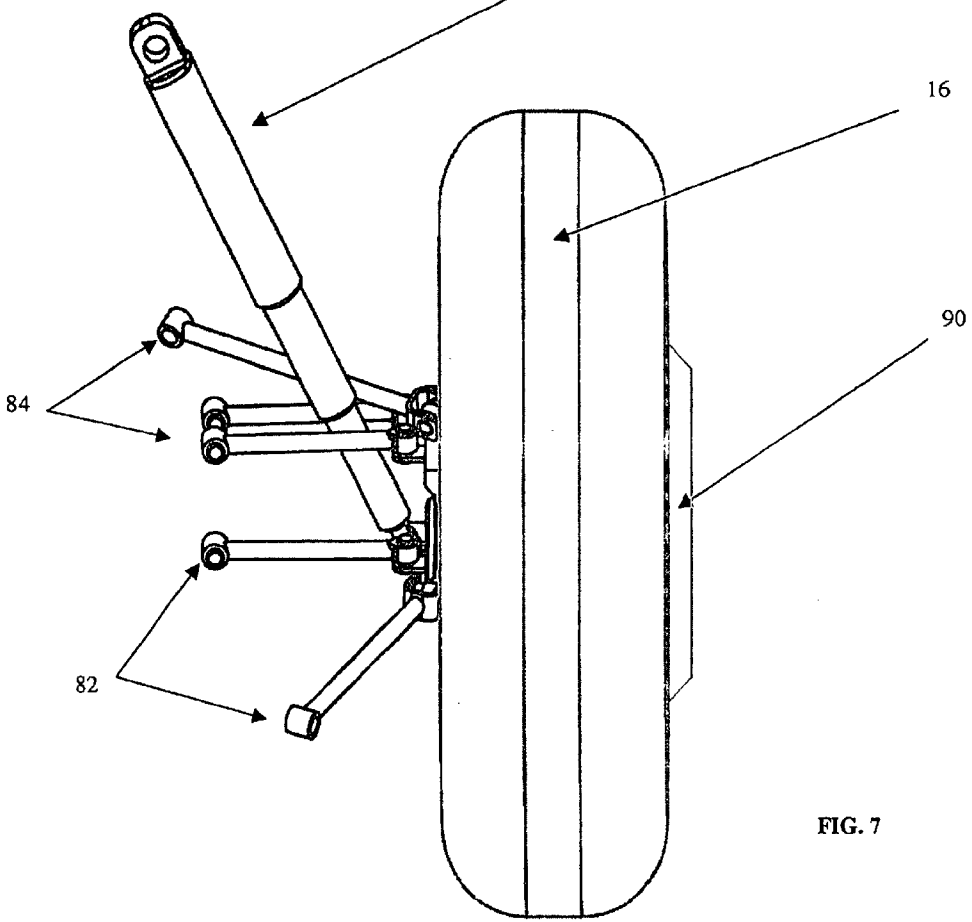
FIG. 7 is an enlarged view of the suspension system of the mobile artillery system.

FIG. 7 is an enraged view of the multi-link suspension system of the mobile artillery system. The suspension system utilizes a multi-link independent suspension comprising a lower link 82 and an upper link 84 with hydro-pneumatic struts for optimum off-road performance. The front wheel 16 is attached to the front wheel hub 00. The suspension system is designed for three functions. The main function is to damp as well as to absorb the shock that is present from the undulating off-road terrain. The hydro-pneumatic struts 85 may use nitrogen gas as their spring and hydraulic fluid as the damper. Some of the advantages of incorporating the multi-link suspension with the hydro-pneumatic suspension are:

1) small space requirement;
2) a kinematic or elasto-kinematic toe-in change tending inwards understeering;
3) easier steerability with existing drive;
4) low weight
5) independence by there being no mutual wheel influence;
6) ability to counteract the change of wheel chamber due to roll pitch of the vehicle body;
7) l lighter off-road mobility and speed;
8) Larger wheel travel;
9) Progressive suspension characteristics allow for high driving speeds while providing improved comfort for driver and crew.

The secondary function of the suspension system is to serve as a shock absorber for the counter-recoil force during firing. The gun recoil force during firing causes the front of the vehicle to lift off the ground. A counter-recall force is usually generated after gun recoil due to a whip-lash effect. As the counter-recall force is tremendous, the suspension at the front of the vehicle has to be sized to absorb and damp the shock so as to prevent damage to the vehicle instrumentation and other systems on-board.

The third function of the suspension system is to provide height adjustment control of the vehicle. This is accomplished by depressurizing the fluid in the cylinders of the hydro-pneumatic struts 86 by means of relief valves (not shown) that are incorporated into the cylinders and thus allow the cylinders to be compressed. The reason for allowing the height adjustment is to enable the howitzer gun 22 to fire at a lower elevation angle. This will contribute to the direct fire capability of the gun. The height outside control will also provide more height clearance in situations where lower height is required, eg. when the vehicle is loaded onto a C-130 airplane.

It should be appreciated that hydro-pneumatic struts using hydro-pneumatic cylinders can also be added to the rear suspension. One advantage of doing so is that the height of the rear of the vehicle is adjustable. This will be very useful for clearing obstacles or difficult terrain.

Hydraulic Drive System

Figure 8:
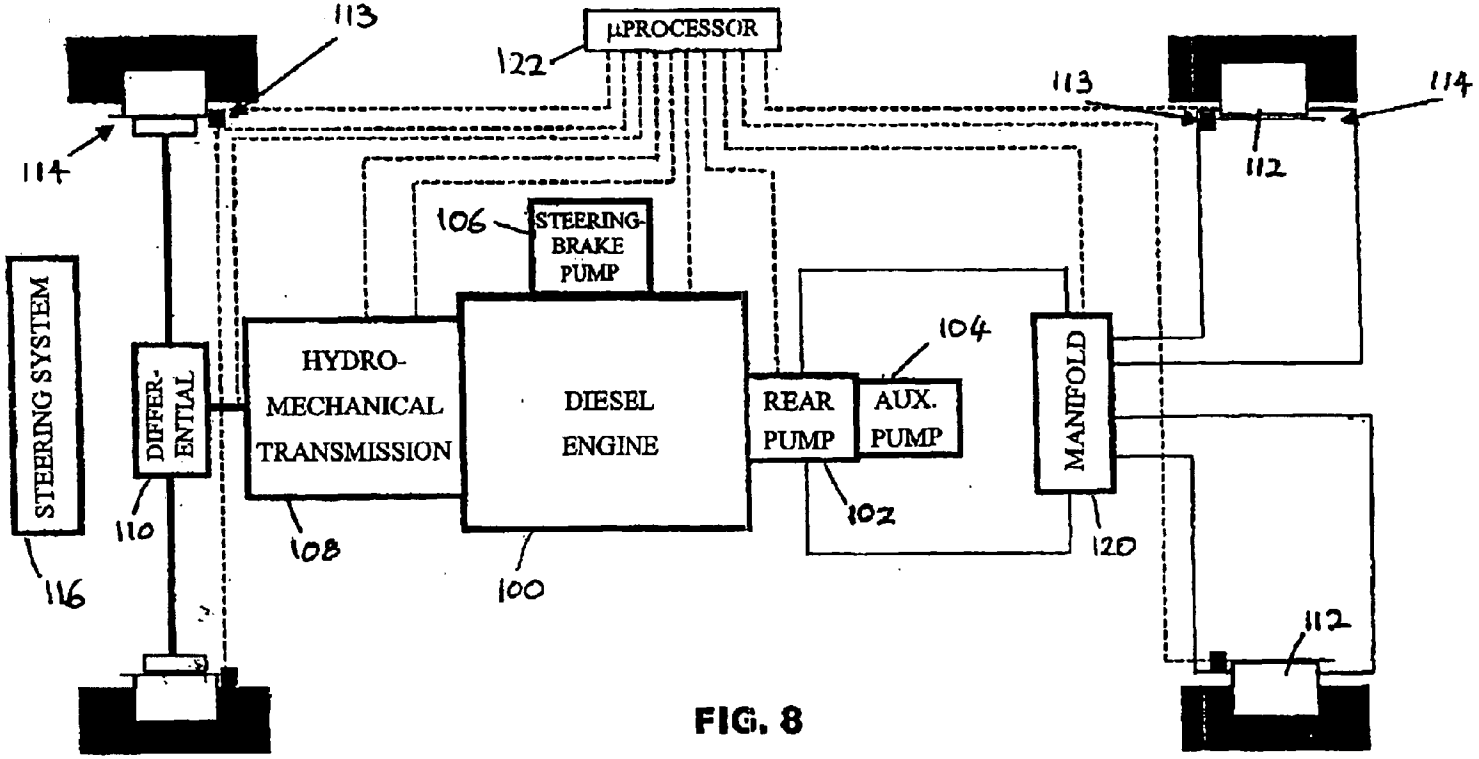
FIG. 8 is a schematic diagram illustrating the various components of the drive mechanism of the mobile artillery system.

FIG. 8 is a schematic diagram illustrating the various components of the driving mechanism of the mobile artillery system. The system includes a turbo-charged inter-cooled diesel engine 100 which is coupled to a rear pump 102, auxiliary pump 104 and steering/brake pump 106. The rear pump 102 is operatively connected to a manifold 120 and to radial in-hub motors 112 towards the rear of the vehicle via fluid drivelines.

There is a switch on the drivers instrumental panel (not shown) which allows the drier of the vehicle to select between front wheel drive mode (on-road), four-wheel drive mode (off-road) and automatic mode. Front wheel drive mode allows the vehicle to travel on rods at lighter speeds. Four-wheel drive mode allows the vehicle to travel off-road up to a maximum speed of about 25 km/h, depending on the hydraulic radial piston in-hub motor. The automatic mode allows the vehicle to travel in a mixed configuration of four wheel drive and two wheel drive depending on the speed of the vehicle. A vehicle speed below 25 km/h will have a four wheel drive configuration while a speed above 25 km/h will have a two wheel drive configuration. The switching of these two modes is controlled automatically by a microprocessor 122. The turbo-charged diesel engine 100 drives a hydro-mechanical transmission 108 comprising 2 shafts: 1) a hydrostatic transmission and 2) a mechanical transmission. The hydromechanical transmission is connected to a differential 110 which drive propeller shafts 18 to which the front wheels 16 are attached.

The input from the engine is split by using two gears (not shown). The hydrostatic transmission consists of a variable displacement pump which is closely coupled to a fixed displacement motor or variable displacement motor. The mechanical transmission consists of a set of planetary gears and a clutch. The purpose of the clutch is to engage and disengage the hydrostatic; and mechanical modes.

Figure 9:
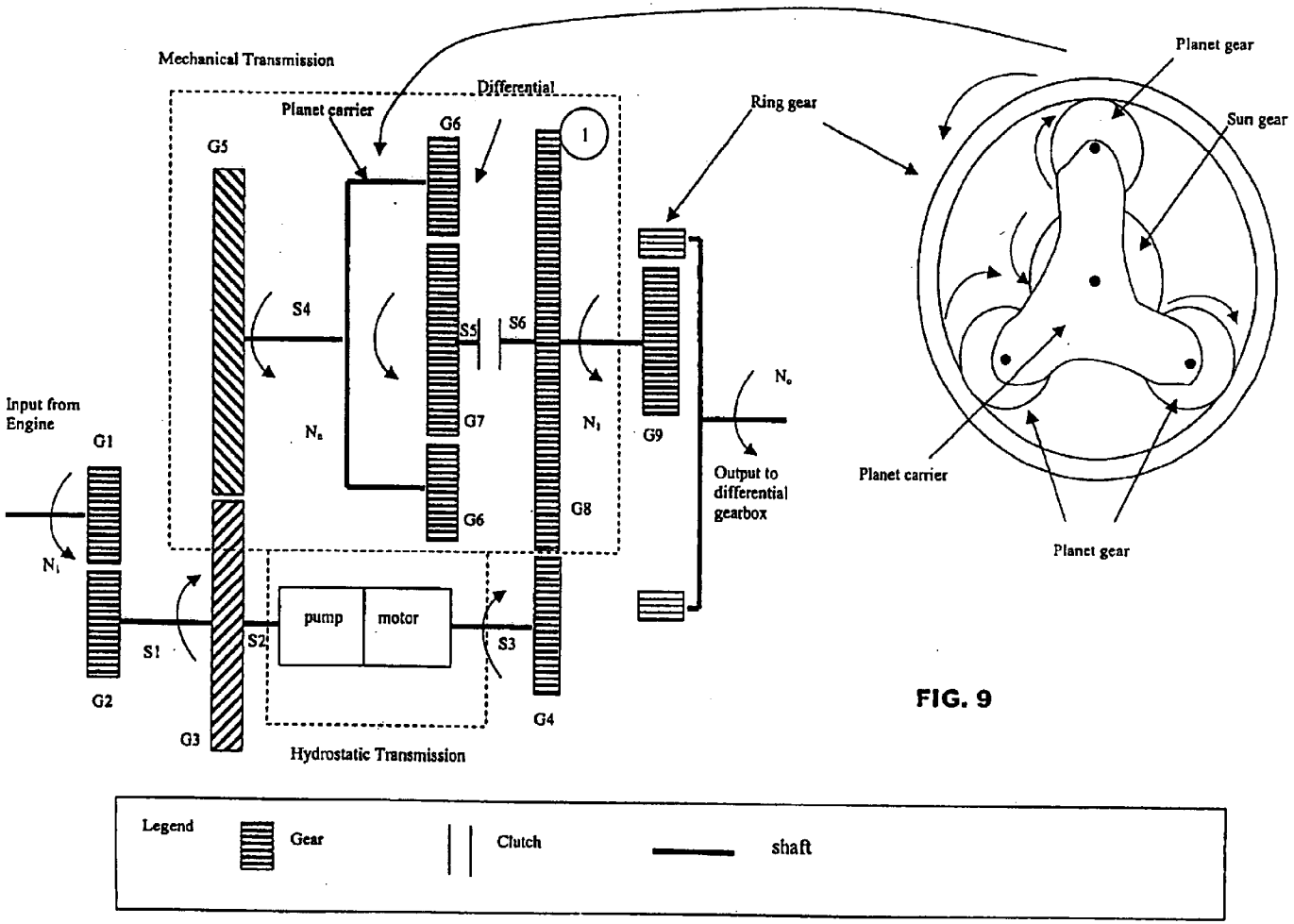
FIG. 9 is a diagrammatical representation of the components of a hydromechanical transmission comprising a mechanical transmission and hydrostatic transmission used in one embodiment of the invention.

The hydrostatic transmission and mechanical transmission will now be described with reference to FIG. 9. In the hydrostatic transmission, whom the engine flywheel rotates a gear G1 in the clockwise direction (as seen from the engine), another gear G2 will rotate in the anti-clockwise direction. The rotation will be transmitted via a shaft S1 to a gear G3. A shaft S2 will drive the input of hydrostatic transmission (pump) and the output win be shaft 83 (from the motor). The torque from the motor will subsequently be transmitted to gear G5 by gear G4. The direction of Gear G5 is the same as the engine rotation. The speed of the hydrostatic transmission can be varied by adjusting the swash plate in the variable displacement pump. As the angle of the swash plate in the pump is increased, more flow results and the motor will turn faster. This will increase the speed of gear G4 and eventually to the output speed $N_0$.

In the mechanical transmission, rotation of gear G5 is effected by gear G3. Gear G5 rotates the shaft S4 in the same direction. Shaft S4 is directly connected to the planetary carrier. The rotation of the planetary carrier will cause all the planetary gears G8 to rotate. Since the sun gear G7 is in direct contact with the planetary gears the sun gear will also rotate together with the planetary gears, which will in turn cause the shaft S5 to rotate in the same direction. With the clutch engaged (hydromechanical mode), this rotation will be transmitted to gear G8 via shaft S6. Gear G8 will then rotate gear G9 via a shaft. The rotation from the gear G9 will be transmitted to the ring gear, which will eventually cause the output shaft to the differential to rotate at the speed of $N_0$.

There are three different drive modes: I) the hydrostatic mode whereby the swashplate is varied to cause the motor to rotate with the clutch disengaged; II) the hydromechanical mode whereby the swashplate is varied and the clutch is disengaged; iii) the swashplate is at zero displacement (no flow to the motor) and the clutch is engaged (fully mechanical).

The front wheels 16 are steerable via a steering system 110 and steeling pump 106. The rear pump 102 also transmits power to a pair of in-hub radial piston motors 112, each of which drives a rear wheel 17. A brake pump 106 is operatively connected to brake calipers 112 which control brake discs 114 at the front and rear wheels 16,17. The components of the system are generally controlled by a microprocessor 122.

The use of the radial piston in-hub motors 112 provide good spatial configuration for the mounting of the weapon platform and allow the weapon recoil force to be fully transferred to the ground through an integrated firing platform. Due to this design, there are fewer requirements on the strength of the space fame 14, thus allowing for weight savings.

The vehicle can move at up to speeds of 80 km/h on 4×2 drive (front wheel drive) on paved roads and the two rear wheels 17 can be activated for 4×4 drive off-road. The vehicle is capable of being deployed and displaced within 30 seconds to 1 minute. It can move 500 meters within 30 seconds and can be ready for firing in less than 30 seconds from the deployed position.

During highway travelling, the hydromechanical transmission is used to drive the front wheels 16 while the rear radial platen motors 112 are allowed to freewheel. During off-road travelling, all the four wheels 16,17 are activated to optimize wheel traction.

The extensive application of lightweight materials such as titanium alloys further helps to reduce the weight of the whole system and enhance its operational mobility.

While a particular embodiment of the invention has boon shown and described, it will be appreciated by those skilled in the art that changes and modifications of the present invention may be made without departing from the invention in broadest aspects. As such, the scope of the invention should not be limited by the particular embodiment and specific construction described herein but should be defined by the appended claims and equivalents thereof. Accordingly, the aim in the appended claims is to cover all such changes and modifications as fall within the spirit and scope of the invention.

What is claimed is:

1. A self-propelled vehicle comprising a chassis on which is mounted an artillery piece, the chassis including a lightweight space frame, at least two rear wheels and at least two front wheels mounted on the chassis, the rear wheels being mounted on the chassis by lifting means by which the rear wheels can be raised and lowered relative to the chassis, wherein said chassis has a rear end which can be lowered to rest on the ground and lifted off the ground when the rear wheels are respectively raised and lowered relative to the chassis by said lifting means, wherein said rear wheels being mounted on the chassis by respective said lifting means, each said lifting means including a wheel arm having one end pivotally attached to the chassis, and an opposite end on which a respective wheel is mounted, wherein said lifting means further include respective hydro-pneumatic struts which are pivotally attached to a respective said wheel arm at a position offset from a point of pivotal attachment of said wheel arm to the chassis such that extension and retraction of the hydro-pneumatic struts produce rotation of the wheel arms relative to the chassis to vary height of the rear wheels relative to the chassis, wherein, in an extended configuration of the hydro-pneumatic struts, the wheel arms extend downwards and rearwards from their respective points of pivotal attachment to the chassis, such that the rear wheels are in contact with the ground for transit of the vehicle, and, upon moving from the extended configuration to a retracted configuration of the hydro-pneumatic struts, the wheel arms are rotated so as to extend upward from their respective points of pivotal attachment to the chassis, such that the rear wheels are lifted off the ground and the rear end of the chassis rests on the ground for firing of the artillery piece.

2. A vehicle as claimed in claim 1, wherein a pair of said wheel arms, each carrying a respective rear wheel and each provided with a respective hydro-pneumatic strut, are provided on respective sides of the vehicle, said pair of wheel arms being interconnected by a pivot axle, and a third hydro-pneumatic strut is connected to a central portion of the pivot axle to provide additional force for rotating said pair of wheel arms.

3. A vehicle as claimed in claim 2, wherein, the hydro-pneumatic struts are operable to rotate said pair of wheel arms to extend forward from their respective points of pivotal attachment to the chassis, such that the rear wheels are brought forward to a fully retracted position for firing of the artillery piece.

4. A vehicle as claimed in claim 1, wherein the hydro-pneumatic struts operate to dampen vibrations from the rear wheels during transit of the vehicle.

5. A vehicle as claimed in claim 1, wherein the hydro-pneumatic struts operate to adjust the height of the rear end of the chassis during transit of the vehicle.

6. A vehicle as claimed in claim 1, wherein, the rear wheels are driven by respective, hydraulic, radial piston, in-hub motors.

7. A vehicle as claimed in claim 1, wherein each said front wheel is connected to the chassis by an independent suspension system.

8. A vehicle as claimed in claim 7, wherein the independent suspension system for each front wheel comprises a multi-link suspension system which includes upper and lower suspension arms and hydro-pneumatic struts respectively connected to at least one of the upper and lower suspension arms and operable to dampen vibrations from the front wheels during transit of the vehicle and also operable to absorb counter-recoil forces during firing of the artillery piece.

9. A vehicle as claimed in claim 8, wherein the hydro-pneumatic struts on the front wheel suspension systems utilize nitrogen gas as a spring and hydraulic fluid as a damper.

10. A vehicle as claimed in claim 9, wherein said hydro-pneumatic struts on the front wheel suspension system have an adjustable length to vary height of a front end of the chassis.

11. A vehicle as claimed in claim 10, wherein each hydro-pneumatic strut is constructed for depressurizing fluid in a cylinder thereof for varying the height of the chassis.

12. A vehicle as claimed in claim 1, further comprising at least one retractable outrigger mounted on the chassis at an end of the vehicle opposite an expected direction of firing of the artillery piece, said at least one outrigger being extendible to an extended configuration in which the outrigger is engageable with the ground to stabilize the vehicle against recoil during firing of the artillery piece in said expected direction, said at least one outrigger being retractable to a retracted configuration in which the outrigger is raised clear of the ground to facilitate transit of the vehicle.

13. A vehicle as claimed in claim 12, wherein two said outriggers are provided, each outrigger being pivotally movable between said extended and retracted configurations by hydraulic pistons.

14. A vehicle as claimed in claim 13, wherein said at least one outrigger carries a spade structure on a free end thereof which embeds in the ground when the outrigger is in the extended configuration to enhance stability of the artillery piece during firing.

15. A vehicle as claimed in claim 1, wherein the artillery piece is mounted on the chassis by at least one shock isolator for damping shock and vibration during transit of the vehicle and during firing of the artillery piece.

16. A vehicle as claimed in claim 15, wherein said at least one shock isolator is mounted on mounting brackets which are mounted on the space frame, whereby, during firing of the artillery piece, a recoil load is transmitted to the at least one shock isolator which, isolates the recoil load from the space frame.

17. A vehicle as claimed in claim 1, wherein the space frame includes an occupant compartment having roll-over bars which can overlie the occupant compartment to protect occupants from injury in the event of roll over of the vehicle.

18. A vehicle as claimed in claim 1, further comprising a hydromechanical transmission to drive the front wheels, the hydromechanical transmission comprising a hydrostatic transmission and a mechanical transmission.

19. A vehicle as claimed in claim 18, wherein the hydromechanical transmission includes an adjustable swashplate pump and hydraulic motor, and a mechanical gearbox including a clutch, and the hydromechanical transmission has a hydrostatic mode in which the swashplate pump drives the hydraulic motor and the gearbox clutch is disengaged, a hydromechanical mode in which the swashplate pump drives the hydraulic motor and the gearbox clutch is engaged, and a fully mechanical mode in which the swashplate pump provides no hydraulic flow to the motor and the gearbox clutch is engaged.

20. A vehicle as claimed in claim 1, wherein the vehicle has a pair of said front wheels and a pair of said rear wheels, and further including a switch by which a driver can select from two or more of the drive transmission modes of: front wheel drive, four wheel drive, and automatic drive in which selection of the front wheel drive or the four wheel drive is performed automatically depending upon the speed of the vehicle.

21. A vehicle as claimed in claim 1, wherein the artillery piece has a caliber of up to 155 mm.

22. A vehicle as claimed in claim 1, wherein the overall weight of the vehicle is less than 8,000 kg.

23. A vehicle as claimed in claim 1, wherein the artillery piece includes an elevating and traversing mass and a gun chassis mounted on the vehicle chassis, said vehicle chassis having a weight which does not exceed 3,800 kg.

24. A vehicle as claimed in claim 1, comprises a cradle and saddle for supporting the artillery piece.

25. A vehicle as claimed in claim 1, wherein the artillery piece is a howitzer gun which includes a barrel.

26. A vehicle as claimed in claim 1, further comprising a barrel clamp for clamping a barrel of the artillery piece to the space frame when the artillery piece is not in use.

27. A vehicle as claimed in claim 1, wherein said space frame comprises a plurality of members spaced apart and interconnected to provide torsional and structural rigidity with relatively low weight.

* * * * *

UNITED STATES PATENT AND TRADEMARK OFFICE

CERTIFICATE OF CORRECTION

PATENT NO. : 6,843,159 B2
APPLICATION NO. : 10/097147
DATED : January 18, 2005
INVENTOR(S) : Chong Guat Pek et al.

It is certified that error appears in the above-identified patent and that said Letters Patent is hereby corrected as shown below:

On title page, item 73, "of Singapore" should read -- of Singapore (1996) Pte. Ltd. --.

Signed and Sealed this

Sixth Day of November, 2007

JON W. DUDAS
*Director of the United States Patent and Trademark Office*